United States Patent [19]

Hubenko

[11] 4,235,362

[45] Nov. 25, 1980

[54] WIRE-FEEDING APPARATUS

[75] Inventor: Nicholas Hubenko, Forest Hills, N.Y.

[73] Assignee: Pfizer Inc., New York, N.Y.

[21] Appl. No.: 22,451

[22] Filed: Mar. 21, 1979

[51] Int. Cl.[3] ..... B65H 17/22

[52] U.S. Cl. ..... 226/181; 226/184; 226/187; 226/193

[58] Field of Search ..... 226/184, 193, 186, 187, 226/188, 181; 242/129

[56] References Cited

U.S. PATENT DOCUMENTS

| | | | |
|---|---|---|---|
| 2,251,291 | 8/1941 | Reichelt | 226/184 |
| 2,668,615 | 2/1954 | Sampatacos | 226/184 |
| 3,022,929 | 2/1962 | Myers et al. | 226/184 |
| 3,331,545 | 7/1967 | Oliveri | 226/187 |
| 3,430,832 | 3/1969 | Meyer | 226/174 |
| 3,672,655 | 6/1972 | Carter | 226/184 |
| 3,815,837 | 6/1974 | Guthrie | 242/129 |

*Primary Examiner*—Leonard D. Christian
*Attorney, Agent, or Firm*—Connolly and Hutz

[57] ABSTRACT

Tubular wire comprising a calcium-containing solidified core in a thin steel sheath is fed between successive sets of resiliently-engaging pinch and feed rollers having aligned V-shaped indented peripheries. A wide range of wire diameters from about 3 to 8 mm are accommodated between a feed roller having an indented relatively sharp obtuse angle of about 120° and a pinch roller having an indented relatively shallow obtuse angle of about 150°. The peripheral walls of the feed rollers have staggered serrations for gripping the wire and a grooved channel between them for removing debris. The pinch rollers of a pair of successive sets are positioned slightly outboard of the feed rollers to keep the wire straight. Simultaneous feeding of two or more wires is provided through a plurality of sets having a common axis of rotation for the feed rollers. A slight drag is imposed on the supply reel as the wire is fed, and the supply reel is stopped just before the feed rollers stop to prevent the wire from unreeling between the supply reel and the feed rollers.

14 Claims, 7 Drawing Figures

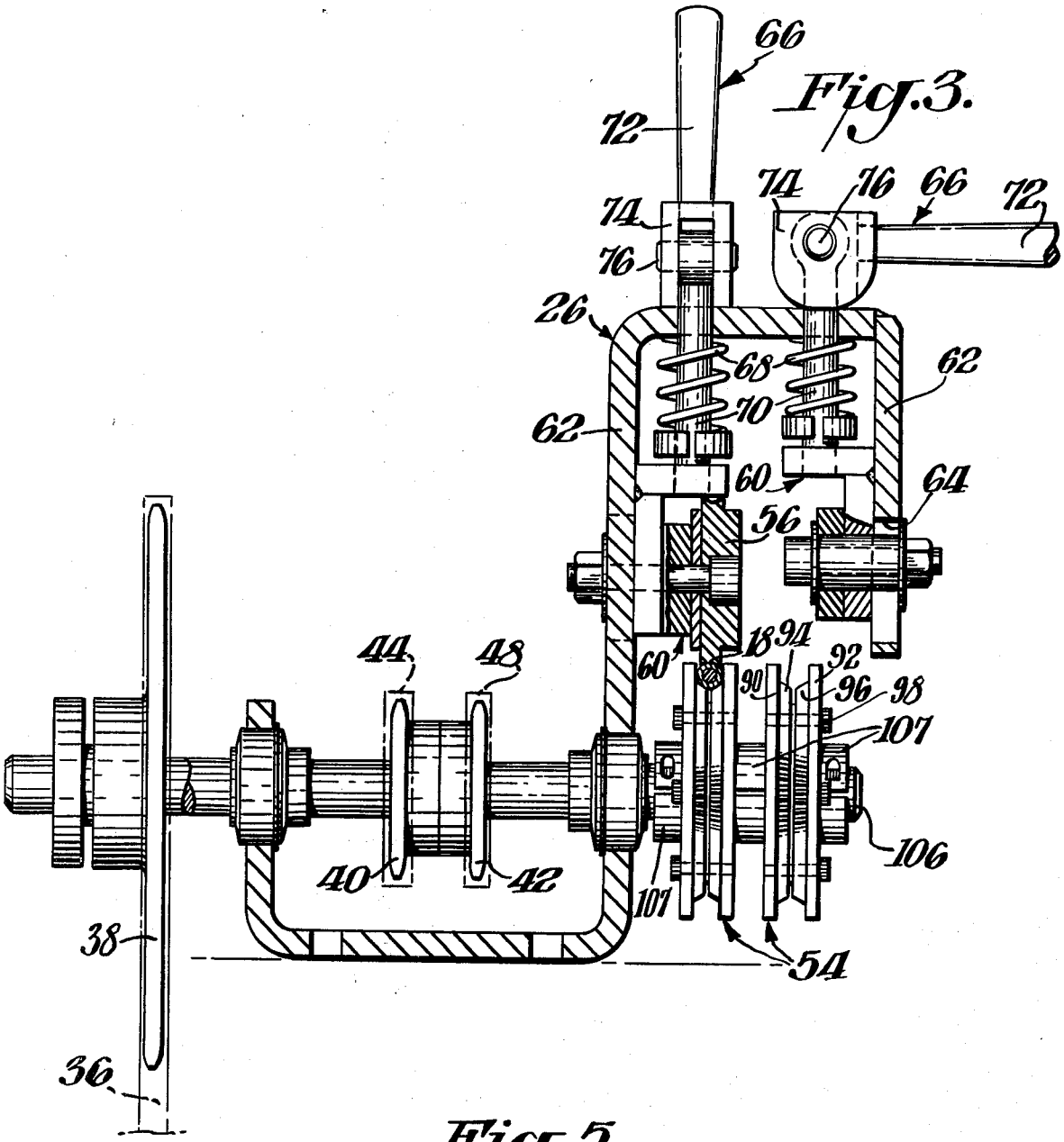
Fig. 3.
Fig. 5.
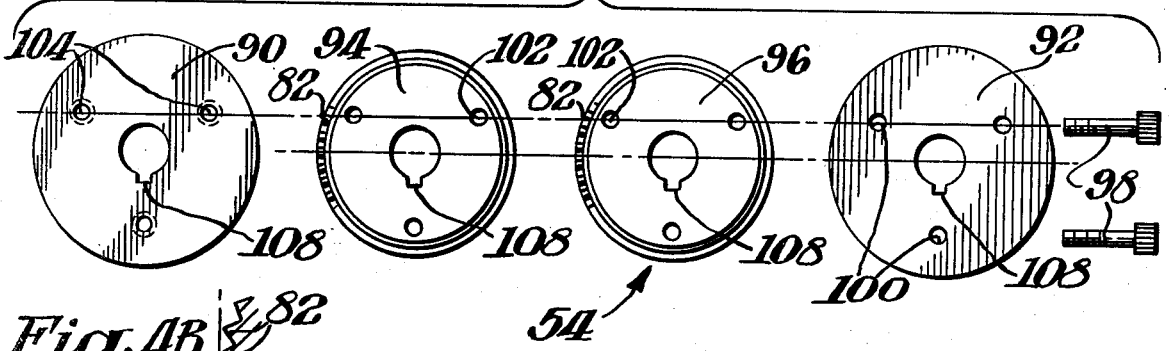
Fig. 4B.
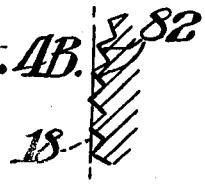

WIRE-FEEDING APPARATUS

BACKGROUND OF THE INVENTION

Numerous apparatus exist for the controlled feeding of solid or tubular wire used in various metal-utilizing processes. Particularly stringent control of such wire feeding is advantageous with iron-sheathed composite calcium materials such as disclosed in U.S. Pat. Nos. 4,035,892 and 4,134,196. Such clad wire if fed into a vessel such as a casting ladle or the tundish of a continuous caster during the steel-making process to greatly enhance the qualities of the steel produced. In such service, it is highly important to feed the wire at a selected rate and to prevent the wire from being bent or deformed by the feed rolls.

SUMMARY OF THE INVENTION

In accordance with this invention, wire is fed between a set of resiliently-engaged feed and pinch rollers having indented V-shaped peripheral cross sections. The peripheral cross section of the pinch roller has a relatively shallow obtuse angle, such as from about 130° to 160°, preferably from about 140° to 150° and most preferably at about 150°, whereas that of the controllably driven feed roller has a relatively sharp obtuse angle, such as from about 100° to 140°, preferably from about 115° to 125° and most preferably at about 120°. Such angles permit a wide range of wire diameters such as from about 2 to 15 millimeters to be dependably fed. The two sloped walls of the peripheral cross section of the feed roller are serrated to help grip the wire, the serrations being preferably regularly spaced with the serrations on one of the walls staggered relative to those on the other wall to improve the gripping action. The serrations preferably comprise triangular teeth having a vertex angle of about 90°.

The feed roller is preferably grooved at the junction of the sloped walls of its peripheral cross section to help remove debris and prevent it from lodging between the wire and the roller. The feed roller is preferably comprised of circular outer flanges and inner disks with beveled edges, with detachable fasteners holding the flanges and disks together, and may further include split hubs secured by detachable fasteners, to facilitate disassembly and reassembly.

The pinch rollers in a pair of successive roller sets are preferably disposed slightly outboard of the feed rollers, which unexpectedly maintains the wire being fed in a substantially straight line, while a plurality of roller sets with the feed rollers having a common axis of rotation is advantageously provided to permit the simultaneous feeding of two or more wires.

Preferably, a slight drag is imposed on the wire supply reel of the apparatus while the wire is being fed and the supply reel is stopped just before the feed roller stops to prevent the supply reel from unreeling ahead of the feed roller.

BRIEF DESCRIPTON OF THE DRAWINGS

Novel features and advantages of the present invention will become apparent to one skilled in the art from a reading of the following description in conjunction with the accompanying drawing wherein similar reference characters refer to similar parts and in which:

FIG. 3 is a composite cross-sectional view taken through FIG. 2 substantially along the line 3—3;

FIG. 4B is a fragmental cross-sectional view of one of the serrated walls of the feed rollers shown in FIGS. 1–4; and FIG. 5 is an exploded view of one of the feed rollers shown in FIGS. 2 and 3.

DESCRIPTION OF THE PREFERRED EMBODIMENT

Figure 1:
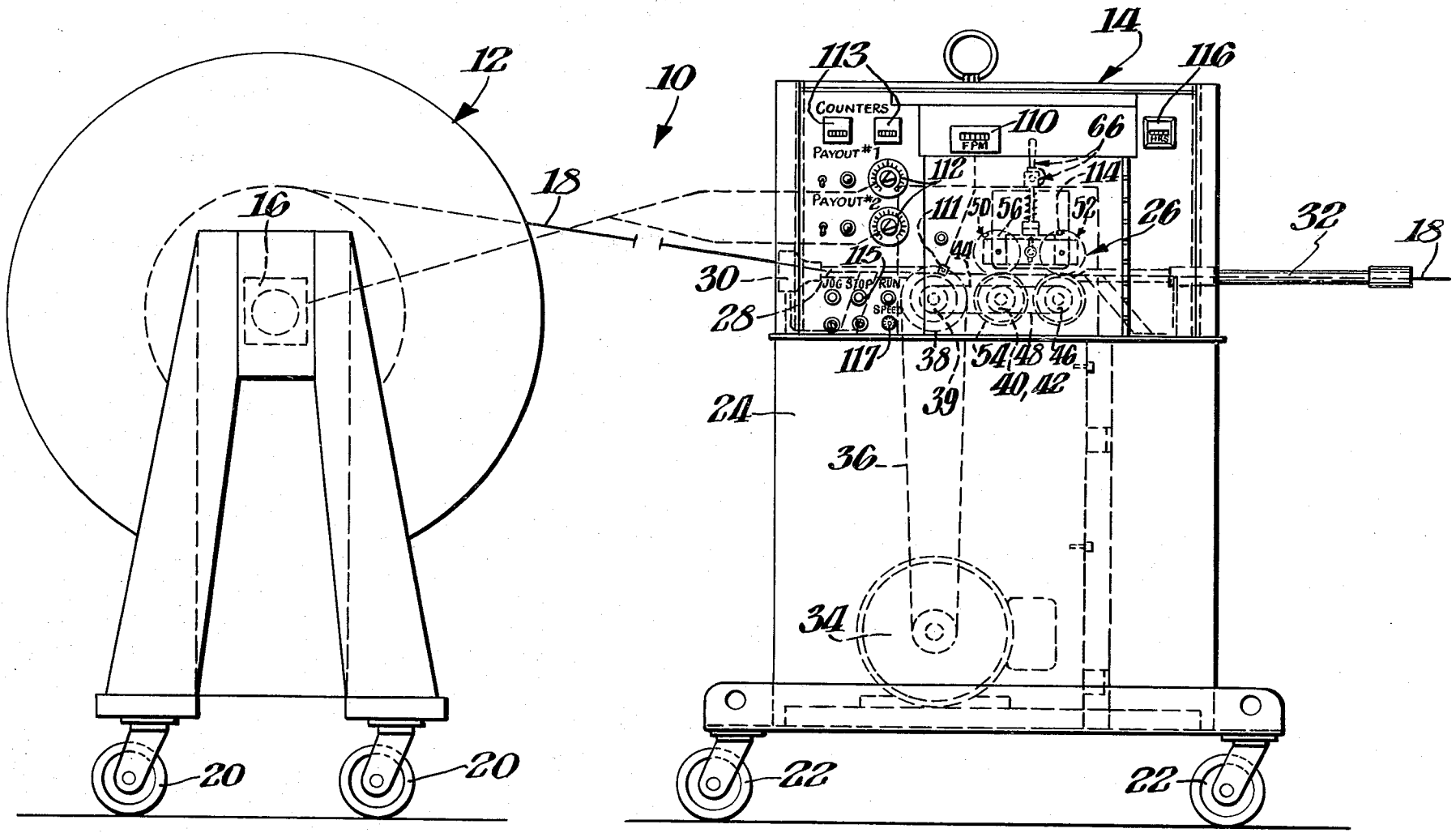
FIG. 1 is a side view in elevation of a wire-feeding apparatus which is one embodiment of this invention.

In FIG. 1 is shown wire-feeding apparatus 10 including a supply reel 12 and feeding unit 14 spaced a convenient distance from each other. An electrically-controlled brake 16 is connected to supply reel 12 to impose a slight drag upon it as wire 18 is being fed and to stop supply reel 12 just before feeding unit 14 stops to prevent wire 18 from loosely unreeling and becoming entangled.

Wire 18 has, for example, a tubular configuration with a solidified predominantly calcium-containing core within an iron or steel sheath. Such wires are, for example, used in treating molten steel and may range in diameter from about 2 to 15 mm and have a sheath about 0.1 to 0.8 mm thick. Suitable wires of this type are described in U.S. Pat. Nos. 4,035,892 and 4,134,196.

Wire supply reel 12 is mounted on four castered wheels 20 for convenient placement. Feeding unit 14 is also mounted on four castered wheels 22 to facilitate its placement.

Feeding unit 14 includes cabinet 24 containing its operative components. The main component in feeding unit 14 is roller assembly 26 into which wire 18 is guided by inlet tube 28 having an enlarged funnel-shaped inlet 30 and from which wire 18 is discharged through outlet tube 32. One feeding unit 14 may include two or more inlet tubes 28 and outlet tubes 32 for optionally simultaneously feeding two or more wires 18, as space will accommodate.

Roller assembly 26 is driven by DC motor 34 connected to it by sprocket chain 36 and input sprocket wheel 38. As shown in greater detail in FIG. 2, input sprocket wheel 38 and sprocket 39 are connected to dual sprocket wheels 40 and 42 by sprocket chain 44, and sprocket wheel 42 is connected to final sprocket wheel 46 by sprocket chain 48. Such a sprocket chain- and -wheel drive provides precisely controlled rotational input to a pair of successive roller sets 50 and 52 each of which incorporates a feed roller 54 and a pinch roller 56. The pinch rollers 56 are rotatably mounted in a yoke 60 centrally aligned between and above feed rollers 54 by cylindrical pin 58 mounted on the casing 62 of roller assembly 26 through slot 64. Yoke 60 is resiliently urged in the direction of feed rollers 54 by releasable spring cam lever assembly 66, which includes compression spring 68 mounted about stem 70 operatively connected to camming lever 72 which rotates cam 74. As shown in FIG. 3, which illustrates roller assembly 26 with two pairs of roller sets 50, 52 for feeding two separate wires 18, rotation of cam 74 about pivot shaft 76 to dispose camming lever 72 in the vertical position reduces the tension on compression spring 68, forces yoke 60 downwardly towards feed roller 54 and resiliently clamps wire 18 between feed roller 54 and pinch roller 56.

Figure 2:
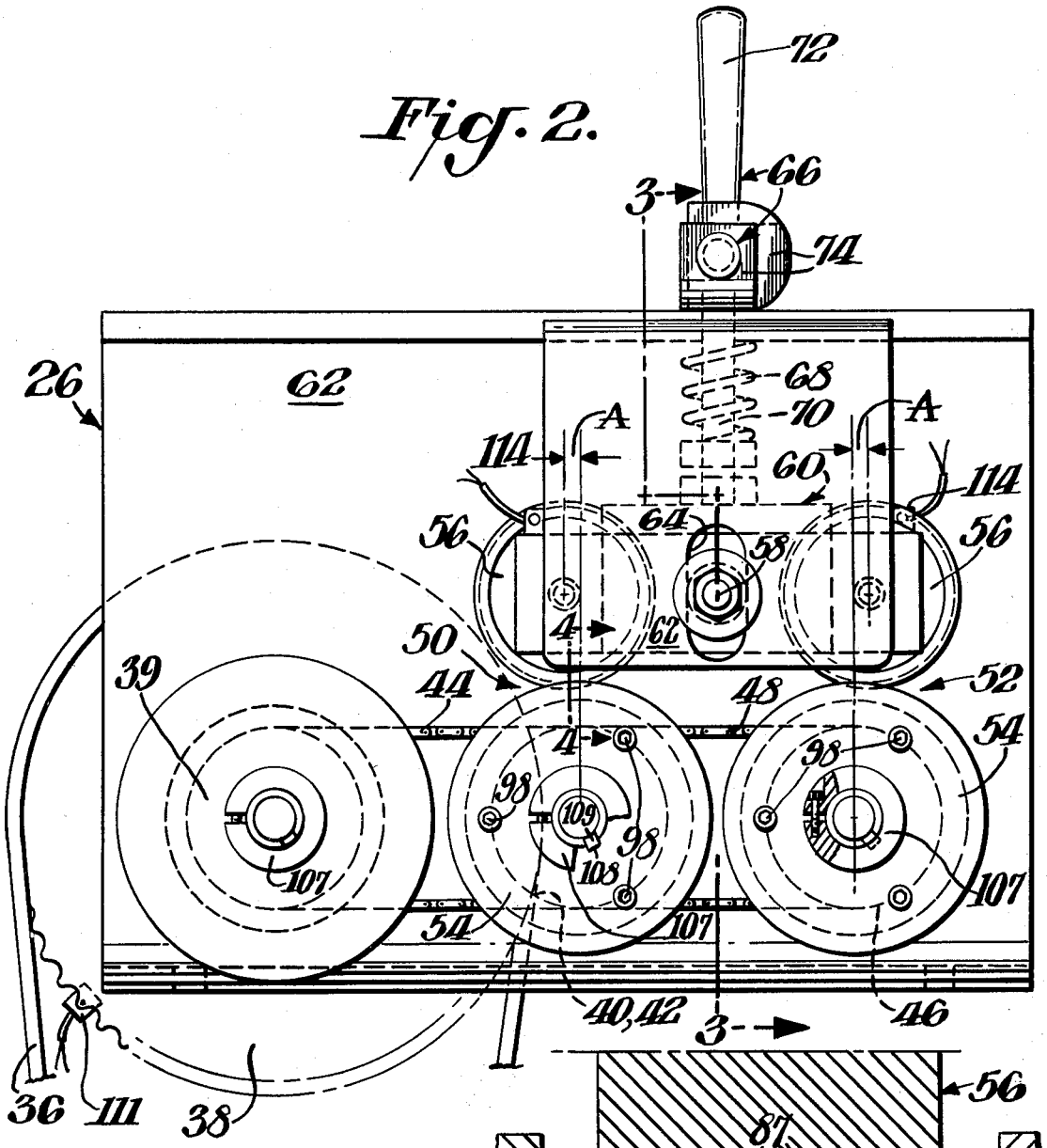
FIG. 2 is a side elevational view of driven sets of feed and pinch rollers utilized in the embodiment shown in FIG. 1.

The centerlines of the pinch rollers 56 in the pair of roller sets 50, 52 are positioned a distance A outboard of the centerlines of the feed rollers 54, as shown in FIG. 2, to keep straight the wire 18 being fed therebetween.

Figure 4:
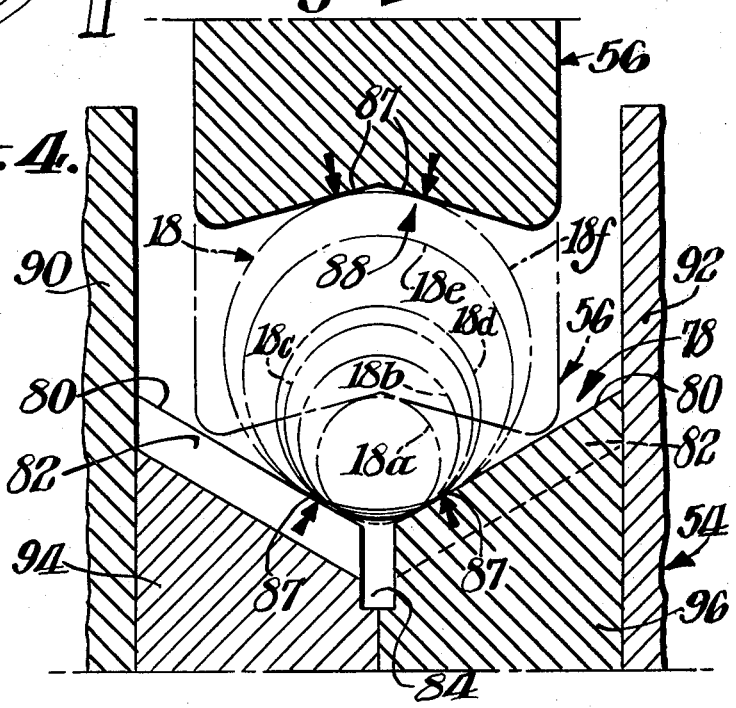
FIG. 4 is a cross-sectional view taken through FIG. 2 along the line 4—4.

Feed roller 54, as shown in FIGS. 3 and 4, has an indented V-shaped periphery 78 with inwardly sloping walls 80 having staggered teeth or serrations 82 which are shown in greater detail in FIG. 4B. Serrations 82 have, for example, a 90° angular tooth to a depth of about 0.050 inch (1.3 mm) in the wall 80. Groove 84 at the intersection of walls 80 extends to a depth of about 0.125 inch (3.2 mm) with a lesser width of about 0.031 inch (0.8 mm) for collecting debris disposed between walls 80 and wire 18 and carrying it away. Such debris is, for example, metal dust gouged from wire 18 by serrations 82 in forming tracks 86 shown in FIG. 4A, which indicates the staggered pattern of tracks 86 as a direct result of the serrations 82 being staggered.

FIG. 4 also shows how various sizes of wire 18 are engaged between pinch roller 56 and feed roller 54. The angle between the walls 80 of V-shaped periphery 78 of feed roller 54 is, for example, from about 100° to 140°, preferably from about 115° to 125°, for feeding wire 18 having diameters of from about 2 to 15 mm. Pinch roller 56 also has an indented V-shaped periphery 88 with an angle such as of from about 130° to 160°, preferably from about 140° to 150°, which effectively cooperates with feed roller periphery 78 to accomodate such 18 diameters and maintain the desired contact hereinafter described. Suitable wires for the optimum angles of 120° feed roller 54 and 150° for pinch roller 56 shown in FIG. 4 range from a small diameter of about 3.2 mm designated by 18*a* to the largest diameter of about 8.0 mm designated by 18*f* with intermediate diameters of, for example, 4.2 mm (18*b*), 4.8 mm (18*c*), 5.2 mm (18*d*) and 7.0 mm (18*e*). In the apparatus shown in FIG. 1, however, only two wire sizes, such as 5.2 mm and 8.0 mm, need be accommodated to achieve ordinary metallurgical requirements.

FIG. 5 shows separated the structure and parts of feed roller 54, an arrangement which facilitates replacement of the parts should they become worn. Each feed roller 54 includes outer flanges 90 and 92 and inner serrated edge disks 94 and 96. Cap screws 98 extend through smooth holes 100 in outer flange 92 and additional smooth holes 102 in serrated edge disks 94 and 96. When cap screws 98 are inserted and screwed into tapped holes 104 in the outer flange 90, they hold feed roller 54 securely together. The assembled reed roller 54 is secured to drive shaft 106 by keyway 108 and a suitable key 109. Split retaining hubs 107 position feed roller 54 on the drive shaft 106 and also make it easy for rapid replacement of the feed roller 54.

Figure 4A:
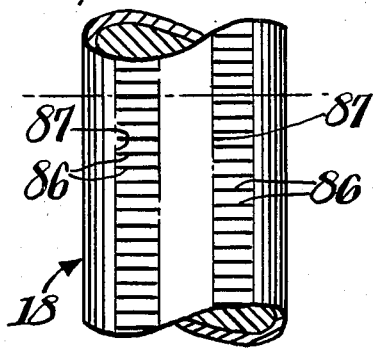
FIG. 4A is a fragmental view in elevation of a portion of the tubular wire being fed from the apparatus shown in FIGS. 1–4.

Compression spring 68 exerts a force of about 10 pounds through pinch rollers 56 on wire 18. This force slightly deforms and flattens four contact portions 87 of the cross section of wire 18, as shown in FIGS. 4 and 4A, in addition to gouging tracks 86 on the surface of wire 18. Such flattening is, however, minor and does not interfere with the ultimate function of the wire to add a certain metallurgical input to the molten steel.

The speed at which wire 18 is fed is monitored as shown in FIG. 1 by tachometer 110 which receives a signal from magnetic pickup 111 which counts the revolutions of input sprocket wheel 38. The wire 18 feed rate is adjusted by speed rheostat 117 which controls the DC motor 34 speed and rheostat 112 which maintains control on brake 16 of wire supply reel 12. In addition, counter 113 can be present for the desired footage of wire 18 to be run and the counter 113 will monitor the revolutions of the pinch rollers 56 through magnetic sensor 114. An audible alarm will be given when the end of the run approaches so an operator can stop the feed by pushing stop button 115, or the counter 113 can, through an automatic built-in mode, not shown, stop the wire-feeding apparatus 10. In either case, brake 16 prevents runoff of wire 18 from the wire supply reel 12 when the feeding unit 14 stops. Various other controls, such as a digital total hours display 116, are also shown in FIG. 1. A remote start-stop control box, not shown, may be used.

Apparatus 10 is, for example, of a heavy duty variety suitable for a wide range of feeding conditions and heavy enough to withstand stringent operating conditions. It is primarily constructed of appropriate materials for the service required, such as different types of steel and other metals. It has a zero speed start-up condition and can feed a number of wires of various diameters at controlled rates of from about 10 to 1800 feet (3 to 550 meters) per minute with uniform pressure on all wires. It is particularly effective for feeding steel-sheathed wire with various types of cores and softer bare wire such as aluminum. All operating controls are covered and protected.

I claim:

1. A wire-feeding apparatus for the controlled feeding of wire comprising a set of two opposed aligned rollers mounted on substantially parallel axes of rotation and with peripheral edges close to each other, one of said rollers being a driven feed roller and the other of said rollers being a pinch roller, drive means connected to said feed roller for rotating it at a controlled rate, both of said rollers having indented V-shaped peripheral cross sections, said peripheral cross section of said feed roller having a relatively sharp obtuse angle, said peripheral cross section of said pinch roller having a relatively shallow obtuse angle, said angles accommodating a wide range of wire diameters, said peripheral cross section of said feed roller having a pair of sloped walls, said walls being serrated to facilitate gripping said wire, and resilient means urging said peripheral edges of said rollers together for gripping said wire between them.

2. A wire-feeding apparatus as set forth in claim 1, wherein said obtuse angle of said feed roller is from about 100° to 140°.

3. A wire-feeding apparatus as set forth in claim 2, wherein said obtuse angle of said pinch roller is from about 130° to 160°.

4. A wire-feeding apparatus as set forth in either of claims 1 or 3, wherein said obtuse angle of said feed roller is about 120°.

5. A wire-feeding apparatus as set forth in either of claims 1 or 2, wherein said obtuse angle of said pinch roller is about 150°.

6. A wire-feeding apparatus as set forth in claim 4, wherein said obtuse angle of said pinch roller is about 150°.

7. A wire-feeding apparatus as set forth in claim 1, wherein said serrations are regularly spaced with said serrations on one said wall being staggered relative to said serrations on the other said wall.

8. A wire-feeding apparatus as set forth in claim 1, wherein said serrations comprise triangular teeth having a vertex angle of about 90°.

9. A wire-feeding apparatus for the controlled feeding of wire comprising a set of two opposed aligned rollers mounted on substantially parallel axes of rotation and with peripheral edges close to each other, one of said rollers being a driven feed roller and the other of said rollers being a pinch roller, drive means connected to said feed roller for rotating it at a controlled rate, both of said rollers having indented V-shaped peripheral cross sections, said peripheral cross section of said feed roller having a relatively sharp obtuse angle, said peripheral cross section of said pinch roller having a relatively shallow obtuse angle, said angles accommodating a wide range of wire diameters, said peripheral cross section of said feed roller having a pair of sloped walls, said walls being serrated to facilitate gripping said wire and provided with a groove at their junction whereby debris is carried away from said walls, and resilient means urging said peripheral edges of said rollers together for gripping said wire between them.

10. A wire-feeding apparatus for the controlled feeding of wire comprising a set of two opposed aligned rollers mounted on substantially parallel axes of rotation and with peripheral edges close to each other, one of said rollers being a driven feed roller and the other of said rollers being a pinch roller, said feed roller comprising circular outer flanges and inner disks with beveled edges, with detachable fasteners holding said flanges and disks together, to facilitate disassembly and reassembly, drive means connected to said feed roller for rotating it at a controlled rate, both of said rollers having indented V-shaped peripheral cross sections, said peripheral cross section of said feed roller having a relatively sharp obtuse angle, said peripheral cross section of said pinch roller having a relatively shallow obtuse angle, said angles accommodating a wide range of wire diameters, said peripheral cross section of said feed roller having a pair of sloped walls, said walls being serrated to facilitate gripping said wire, and resilient means urging said peripheral edges of said rollers together for gripping said wire between them.

11. A wire-feeding apparatus as set forth in claim 10, wherein said feed roller includes split hubs secured by detachable fasteners to further facilitate disassembly and reassembly.

12. A wire-feeding apparatus as set forth in claim 1, wherein a pair of said sets is arranged in succession with the centers of said pinch rollers a short distance outboard of the centers of said feed rollers, whereby said wire fed from said apparatus is maintained substantially straight.

13. A wire-feeding apparatus as set forth in claim 1, wherein a plurality of said sets is arranged with said feed rollers having a common axis of rotation, whereby a plurality of said wires may be fed simultaneously.

14. A wire-feeding apparatus as set forth in claim 1, wherein a supply reel is mounted adjacent and ahead of said feed roller for providing a supply of said wire thereto, a brake being connected to said supply reel, operating control means being connected to said drive means for said feed roller and to said brake, and said operating control means being constructed and arranged to maintain a drag on said supply reel while said feed roller is being driven and to stop said supply reel just prior to stoppage of said feed roller.

* * * * *